US005503391A

United States Patent [19]

Stelly

[11] Patent Number: 5,503,391

[45] Date of Patent: Apr. 2, 1996

[54] SWING MASTER

[76] Inventor: Thomas G. Stelly, 1307 W. Hazel St., Opelousas, La. 70570

[21] Appl. No.: 285,212

[22] Filed: Aug. 3, 1994

[51] Int. Cl.[6] ..... A63B 69/40

[52] U.S. Cl. ..... 273/26 R

[58] Field of Search ..... 273/26 R, 29 R, 273/29 A

[56] References Cited

U.S. PATENT DOCUMENTS

| | | | |
|---|---|---|---|
| 3,550,938 | 12/1970 | Cunningham | 273/26 R |
| 4,097,044 | 7/1978 | Miniere | 273/26 R |
| 4,451,036 | 5/1984 | Sinclair | 273/26 R |
| 4,655,452 | 4/1987 | Huerstel | 273/26 R |

*Primary Examiner*—Theatrice Brown

[57] ABSTRACT

A new and improved swing master having a base section and a plate section. The plate section has an upper section and a lower section. The lower section is secured to the base section by a fastening means. The upper section is rotatably secured to the lower section with a plurality of ball bearings disposed therebetween. A post mount is secured to the upper section of the plate section. A vertical post is received in the post mount and has a mounting bracket secured thereon. A rubber tire has an opening therethrough. The rubber tire receives the vertical post through the opening and is secured to the mounting bracket of the vertical post. A series of baseballs are painted on the outer surface of one of the two sidewalls.

5 Claims, 4 Drawing Sheets

SWING MASTER

BACKGROUND OF THE INVENTION

1. Field of the Invention

The present invention relates to a swing master and more particularly pertains to developing and improving the hitting skills of baseball players with a swing master.

2. Description of the Prior Art

The use of training devices is known in the prior art. More specifically, training devices heretofore devised and utilized for the purpose of training athletes are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,072,937 to Zarate discloses a baseball batting practice device.

U.S. Pat. No. 5,082,262 to Sanches discloses a training device for baseball batter and method therefor.

U.S. Pat. No. 5,087,039 to Laske discloses a baseball bat swing device.

U.S. Pat. No. 5,056,784 to Craig discloses an athletic swing training device.

U.S. Pat. No. 5,158,299 to Otter discloses a ball striking club training and exercising device.

While these devices fulfill their respective, particular objective and requirements, the aforementioned patents do not describe a swing master that develops and improves the hitting skills of baseball players.

In this respect, the swing master according to the present invention substantially departs from the conventional concepts and designs of the prior art, and in doing so provides an apparatus primarily developed for the purpose of developing and improving the hitting skills of baseball players.

Therefore, it can be appreciated that there exists a continuing need for a new and improved swing master which can be used for developing and improving the hitting skills of baseball players. In this regard, the present invention substantially fulfills this need.

SUMMARY OF THE INVENTION

In the view of the foregoing disadvantages inherent in the known types of training devices now present in the prior art, the present invention provides an improved swing master. As such, the general purpose of the present invention, which will be described subsequently in greater detail, is to provide a new and improved swing master and method which has all the advantages of the prior art and none of the disadvantages.

To attain this, the present invention essentially comprises a base section having an upper surface, a lower surface, a right section, a left section, and a center section. The right section and left section function as batting boxes for the user. The device contains a plate section having an upper section and a lower section. The upper section has an upper surface and a lower surface. The lower section has an upper surface and a lower surface. The lower surface of the lower section is secured to the upper surface of the center section of the base section by a fastening means. The lower surface of the upper section is rotatably secured to the upper surface of the lower section with a plurality of ball bearings disposed therebetween. The device contains a post mount having an open first end and a closed second end. The second end is secured to the upper surface of the upper section of the plate section. The open first end has a securement aperture formed downwardly thereof. The device contains a vertical post having a first end, a second end, and an intermediate extent therebetween. A plurality of vertically aligned apertures are formed in the intermediate extent upward of the first end. The first end is received in the open first end of the post mount. The second end has a mounting bracket secured thereon. The mounting bracket has two apertures formed therethrough. A securement pin adjustably couples the vertical post to the mounting post through the securement aperture of the mounting post and the plurality of vertical apertures of the vertical post. The securement pin functions to adjust the height of the vertical post to accommodate a user. The device contains a rubber tire having an upper end, a lower end, two sidewalls, an inner surface, and an outer surface. The lower end has an opening therethrough. The outer surface of the upper end has two apertures formed therethrough. The rubber tire receives the second end of the vertical post through the opening in the lower end. The inner surface of the upper end is secured to the mounting bracket of the vertical post by a fastening means through the two apertures of the mounting bracket and the two apertures of the upper end. A series of baseballs are painted on the outer surface of one of the two sidewalls.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved swing master which has all the advantages of the prior art training devices and none of the disadvantages.

It is another object of the present invention to provide a new and improved swing master which may be easily and efficiently manufactured and marketed.

It is a further object of the present invention to provide a new and improved swing master which is of durable and reliable construction.

An even further object of the present invention is to provide a new and improved swing master which is susceptible of a low cost of manufacture with regard to both materials and labor, and which accordingly is then susceptible of low prices of sale to the consuming public, thereby making such a swing master economically available to the buying public.

Still yet another object of the present invention is to provide a new and improved swing master which provides in the apparatuses and methods of the prior art some of the advantages thereof, while simultaneously overcoming some of the disadvantages normally associated therewith.

Even still another object of the present invention is to provide a new and improved swing master for developing and improving the hitting skills of baseball players.

Lastly, it is an object of the present invention to provide a new and improved swing master having a base section and a plate section. The plate section has an upper section and a lower section. The lower section is secured to the base section by a fastening means. The upper section is rotatably secured to the lower section with a plurality of ball bearings disposed therebetween. A post mount is secured to the upper section of the plate section. A vertical post is received in the post mount and has a mounting bracket secured thereon. A rubber tire has an opening therethrough. The rubber tire receives the vertical post through the opening and is secured to the mounting bracket of the vertical post. A series of baseballs are painted on the outer surface of one of the two sidewalls.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
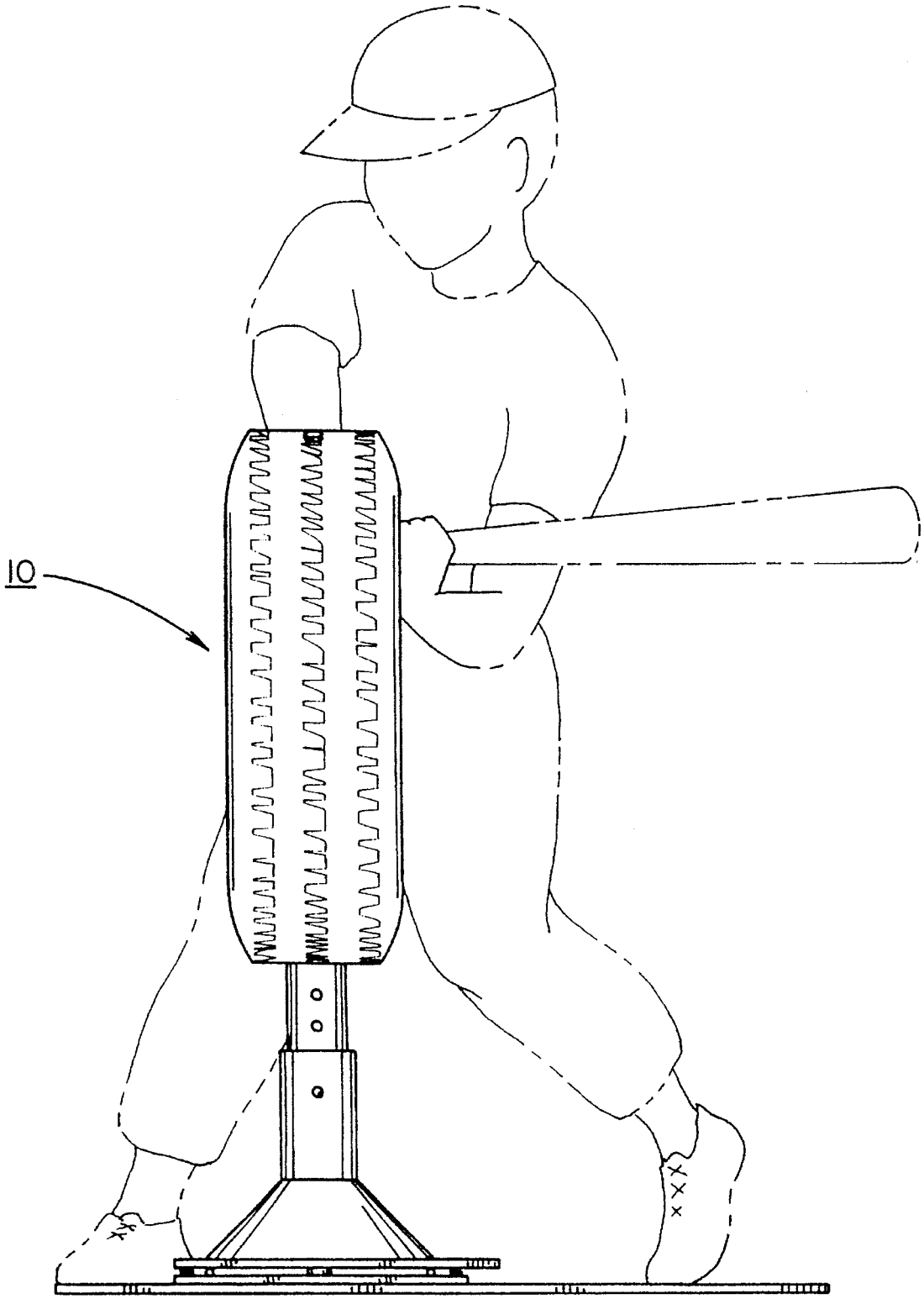
FIG. 1 is a perspective view of the preferred embodiment of the swing master constructed in accordance with the principles of the present invention.
Figure 2:
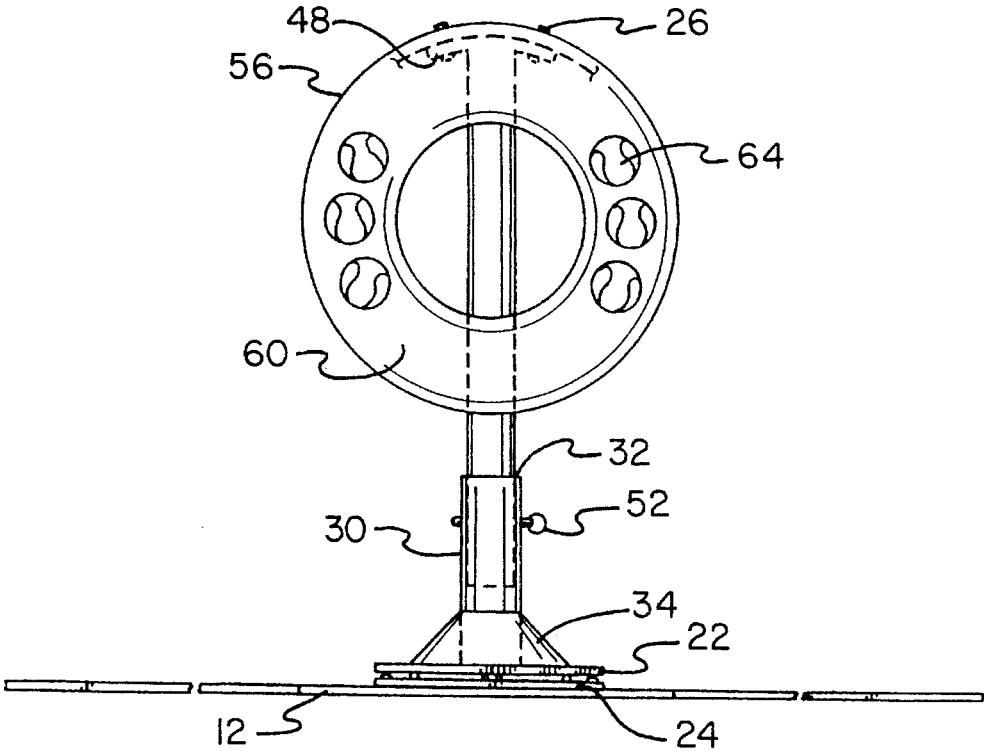
FIG. 2 is a front view of the present invention illustrating the baseballs painted on the sidewall of the tire.
Figure 3:
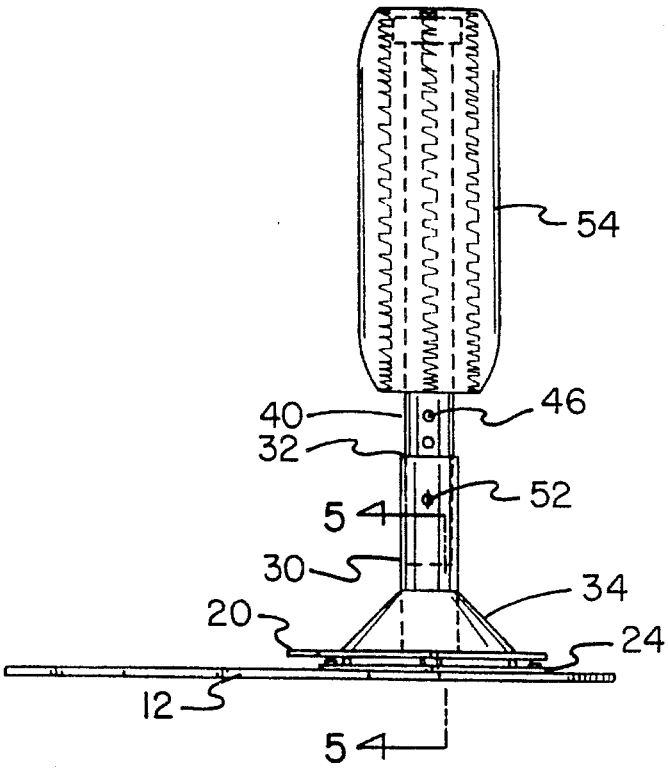
FIG. 3 is a side view of the present invention illustrating adjustable height.
Figure 4:
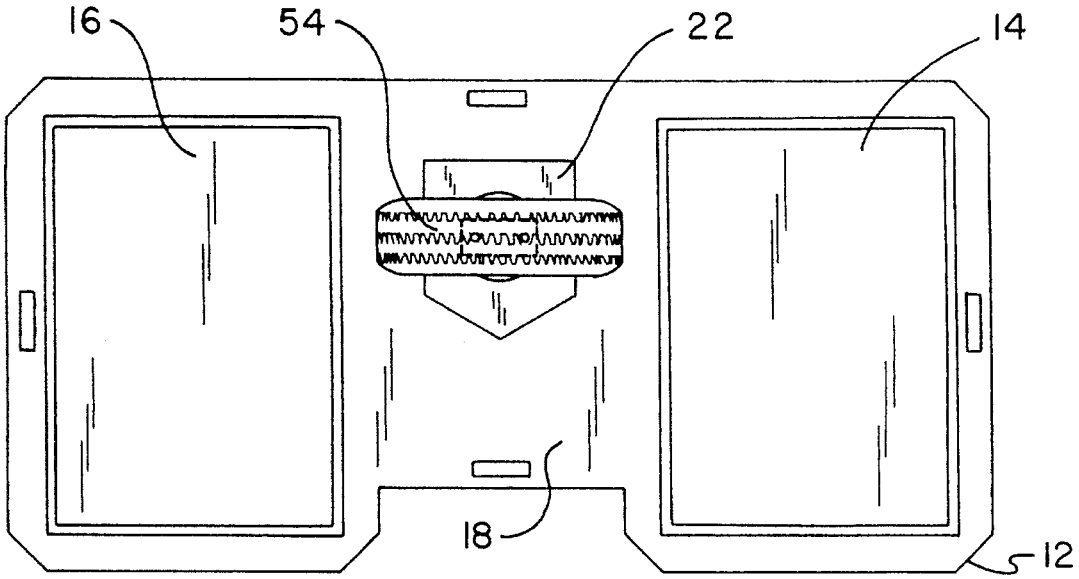
FIG. 4 is a plan view of the present invention illustrating the layout of the base section.
Figure 5:
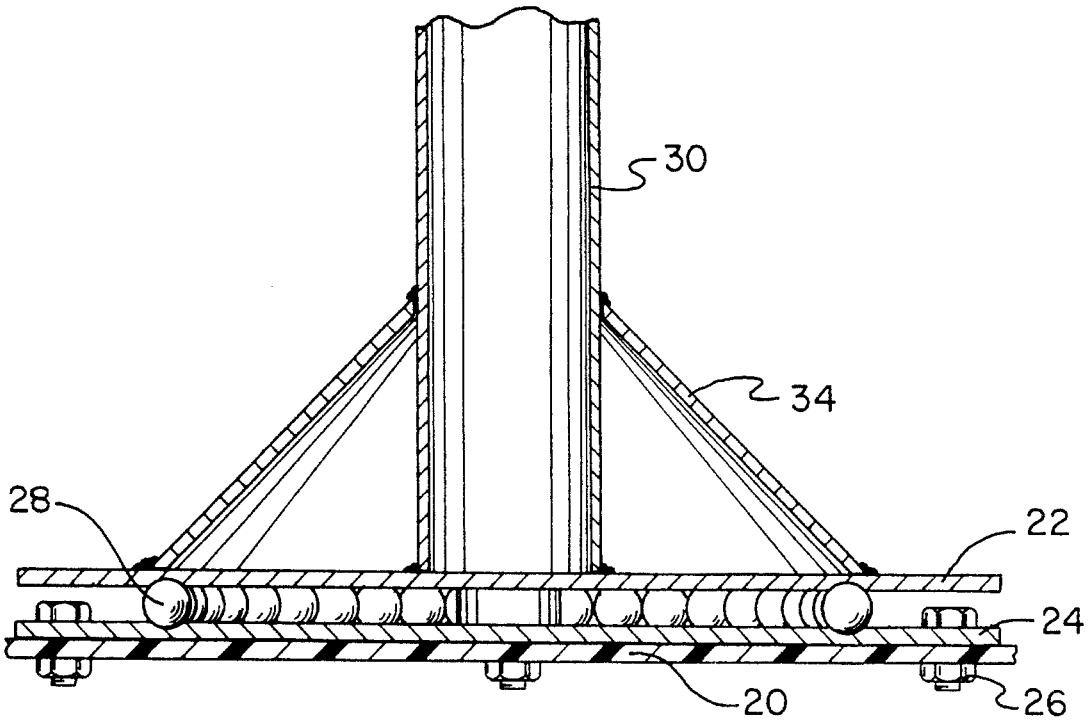
FIG. 5 is a cross-sectional view taken along line 5—5 of FIG. 3.
Figure 6:
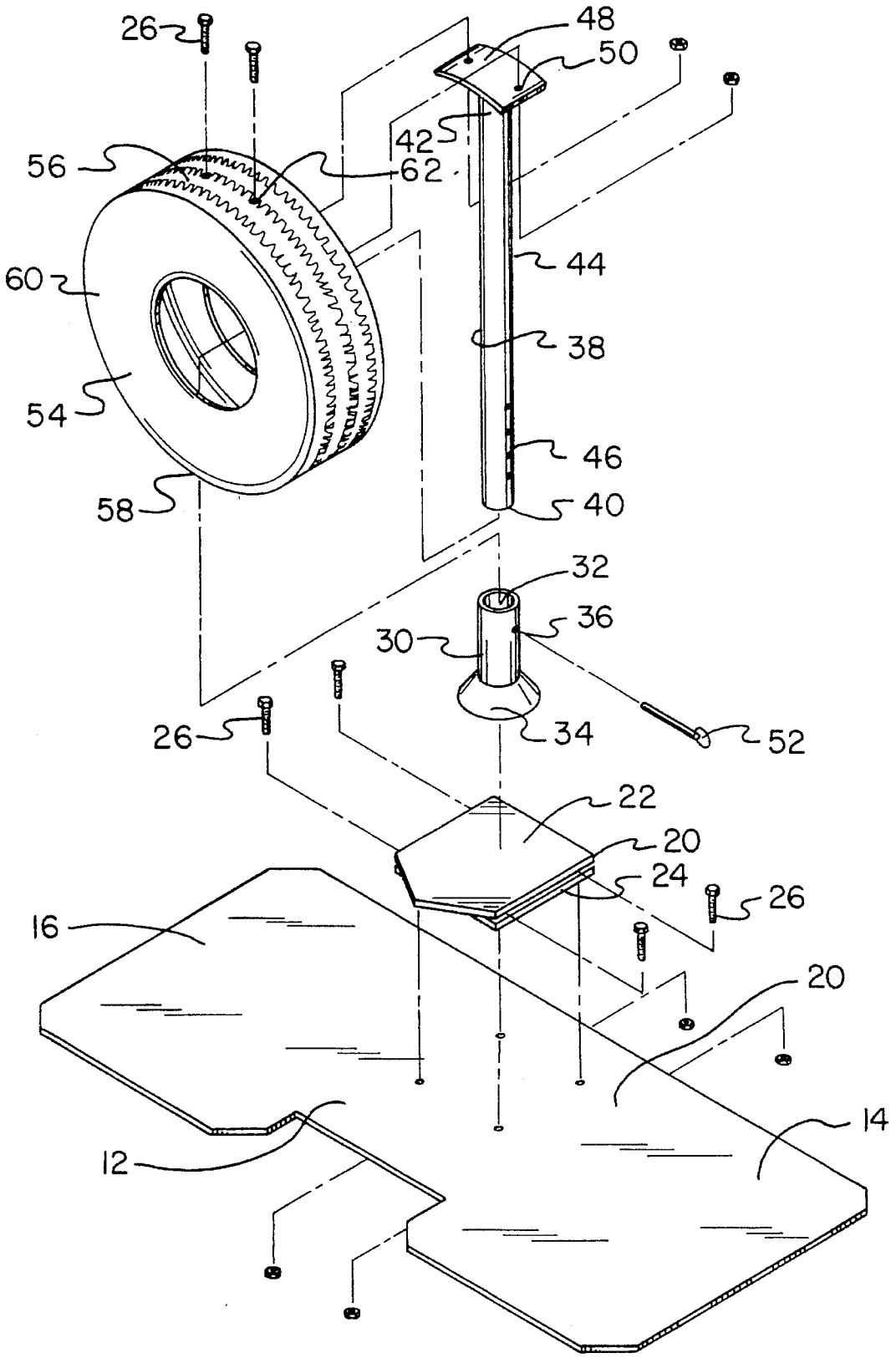
FIG. 6 is an exploded view of the preferred embodiment of the present invention.

With reference now to the drawings, and in particular, to FIG. 1 thereof, the preferred embodiment of the new and improved swing master embodying the principles and concepts of the present invention and generally designated by the reference number 10 will be described.

Specifically, it will be noted in the various Figures that the device relates to a new and improved swing master for developing and improving the hitting skills of baseball players. In its broadest context, the device consists of a base section, a plate section, a post mount, a vertical post, a securement post, and a rubber tire.

The device 10 contains a base section 12 having an upper surface, a lower surface, a right section 14, a left section 16, and a center section 18. The right section 14 and left section 16 function as batting boxes for the user. The base section 12 resembles a complete batters box where the center section 16 has a width of two feet and the right section and the left section have a width of three feet.

The device 10 contains a plate section 20 having an upper section 22 and a lower section 24. The upper section 22 has an upper surface and a lower surface. The lower section 24 has an upper surface and a lower surface. The lower surface of the lower section 24 is secured to the upper surface of the center section 18 of the base section 12 by a fastening means 26. The lower surface of the upper section 22 is rotatably secured to the upper surface of the lower section 24 with a plurality of ball bearings 28 disposed therebetween. The plate section 20 is the same size and dimension as a home base that is used on a baseball field. The ball bearings allow the upper section 22 to spin freely in relation to the lower section 24.

The device 10 contains a post mount 30 having an open first end 32 and a closed second end 34. The second end 34 is secured to the upper surface of the upper section 22 of the plate section 20. The open first end 32 has a securement aperture 36 formed downwardly thereof.

The device 10 contains a vertical post 38 having a first end 40, a second end 42, and an intermediate extent 44 therebetween. A plurality of vertically aligned apertures 46 are formed in the intermediate extent 44 upward of the first end 40. The first end 40 is received in the open first end 32 of the post mount 30. The second end 42 has a mounting bracket 48 secured thereon. The mounting bracket 48 has two apertures 50 formed therethrough. The plurality of vertically aligned apertures 46 allow the vertical post 38 to be adjusted to accommodate a variety of users.

A securement pin 52 adjustably couples the vertical post 38 to the post mount 30 through the securement aperture 36 of the post mount 30 and the plurality of vertical apertures 46 of the vertical post 38. The securement pin 52 functions to adjust the height of the vertical post 38 to accommodate a user. This feature enables the marketing of the device to users of different heights.

The device 10 contains a rubber tire 54 having an upper end 56, a lower end 58, two sidewalls 60, an inner surface, and an outer surface. The lower end 58 has an opening therethrough. The outer surface of the upper end 56 has two apertures 62 formed therethrough. The rubber tire 54 receives the second end 42 of the vertical post 38 through the opening in the lower end 58. The inner surface of the upper end 56 is secured to the mounting bracket 48 of the vertical post 38 by a fastening means 26 through the two apertures 50 of the mounting bracket 48 and the two apertures 62 of the upper end 56. A series of baseballs 64 are painted on the outer surface of one of the two sidewalls 60. The rubber tire 54 is used as the striking surface by a user with a baseball bat. When the tire 54 is struck it rotates safely around as the only part of the device that moves is the upper section 22 of the plate section 20 that rotates on the plurality of ball bearings 28.

The present invention is a stationary device which will be very helpful in developing and improving the hitting skills of baseball players. It can be used with youngsters just learning to play, as well as those who have advanced considerably and wish to improve their swings, technique, and concentration. It also enables them to pinpoint their weaknesses and strengths so they can be more selective in which pitches to take whenever possible, while waiting for one to be delivered "in their wheelhouse." Hopefully, they will eventually overcome their difficulties and be able to hit any pitch which is within, or close to, the strike zone.

This device has the advantage of never placing a batter in danger of being hit by a pitched ball—because no ball is used and nothing is thrown. This feature is very valuable since it eliminates the basic fear of every youngster who starts to play the sport, that of being hit by a rock-hard baseball.

The present invention utilizes an automobile tire. It is mounted on a vertical post that is free to spin and can be adjusted so it is in the hitting zone of the batter. Three baseballs are painted on the sidewall, in locations that represent low, medium, and high pitches. The hitter swings at one of the three balls and learns to develop good contact and ideal swing mechanics. These include proper weight distribution, weight shifting, hip and body rotation, use of the arms, plane of the swing, the follow through, and other principles. The post spins easily when the bat hits the tire, so there is little reaction on contact.

A sturdy base is provided for the pole, and homeplate is displayed, as well as the batting boxes on each side. The present invention can be set up outside or inside, requiring only a small area for its use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A bat swing practice apparatus for developing and improving the hitting skills of baseball players comprising, in combination:

A base section having an upper surface, a lower surface, a right suction, a left section and a center section between said left and right sections, said right and left sections functioning as batting boxes for a player;

A double plate section having an upper plate and a lower plate said upper plate having upper and lower surfaces, said lower plate having upper and lower surfaces, said lower surface of said lower plate being secured by fastening means to said upper surface of said center section of said base section, said lower surface of said upper plate being rotatably secured to said upper surface of said lower plate by a plurality of ball bearings disposed therebetween;

a vertically extending tubular post mount having an open first end and a closed second end, said second end being secured to said upper surface of said upper plate of said double plate section, said post mount having a transverse aperture formed adjacent said first end;

A vertical post having first and second ends, and a plurality of transversely extending, vertically aligned apertures adjacent said first end, said first end of said vertical post being telescopically inserted in said first end of said tubular post mount, said second end of said vertical post having a mounting bracket attached thereto, said mounting bracket having a pair of spaced apart apertures extending therethrough.

A securement pin adjustably coupling said vertical post to said post mount by extending through transversely aligned apertures of said vertical post and said post mount, said securement pin and apertures functioning to allow adjusting the height of said vertical to accommodate a player;

A hollow rubber tire positioned to have an upper portion, a lower portion, two spaced apart, substantially vertical sidewalls, an inner surface, and an outer surface, said sidewalls being connected by a substantially horizontal web having inner and outer surfaces; said web having an aperture extending therethrough at said lower portion of said rubber tire, and said web further having a pair of apertures extending therethrough at said upper portion of said tire, said vertical post extending through said aperture in said web at said lower portion of said tire, and said mounting bracket being secured by fastening means to said inner surface of said web at said upper portion of said tire, said fastening means extending through said apertures in said web at said upper portion of said tire and said mounting bracket;

indicia representing a series of baseballs painted on said outer surface of said sidewalls.

2. A bat swing practice apparatus comprising, in combination:

A base section;

a double plate section having an upper plate and a lower plate, said lower plate being secured to said base section by fastening means, said upper plate being rotatably secured to said lower plate by a plurality of ball bearings disposed therebetween;

A tubular, vertically extending post mount secured to said upper plate;

a vertically extending post having its lower end telescopically received in said post mount and having a mounting bracket attached to it's upper end;

a vertically oriented hollow rubber tire having opposed sidewalls, and a substantially horizontal web, said web extending between said sidewalls, said web having inner and outer surfaces;

an opening extending through said web at a lowermost portion of said tire, said vertically extending post extending through said opening and having said mounting bracket attached to said inner surface of said web at an upper most portion of said tire;

indicia representing a series of baseball pointed on the outer surface of one of said sidewall.

3. The bat swing practice apparatus defined in claim 2 wherein;

said post mount has a transverse aperture extending therethrough and adjacent its upper end.

4. The bat swing apparatus defined in claim 3 wherein;

said vertically extending post has a plurality of vertically aligned, transverse apertures adjacent its lower end.

5. The bat swing apparatus defined in claim 4 wherein a securement pin couples the vertical post to the post mount by extending through aligned aperture of the post mount and the plurality of vertical apertures of the vertical post, the securement pin and apertures functioning to allow adjusting the height of the vertical post to accommodate a user.

* * * * *